United States Patent [19]

Brookstein et al.

[11] 4,290,170

[45] Sep. 22, 1981

[54] DEVICE FOR ALIGNING THE ATTENUATING FIBER MATS

[75] Inventors: David S. Brookstein, Marietta; Alton R. Colcord, Atlanta, both of Ga.

[73] Assignee: Union Carbide Corporation, New York, N.Y.

[21] Appl. No.: 134,639

[22] Filed: Mar. 27, 1980

[51] Int. Cl.[3] ..... D01H 5/26; D01H 5/74

[52] U.S. Cl. ..... 19/236; 19/244; 19/248; 19/258; 19/308; 57/90; 57/315; 423/447.2

[58] Field of Search ..... 19/236, 242, 244, 246, 19/247, 248, 249, 251, 252, 258, 263, 266, 272, 281, 284, 282, 286, 296, 308, 106 R; 423/447.1, 447.2, 449; 57/90, 315

[56] References Cited

U.S. PATENT DOCUMENTS

| | | | |
|---|---|---|---|
| 2,450,915 | 10/1948 | Powell | 19/308 X |
| 2,687,363 | 8/1954 | Manning | 19/308 X |
| 2,938,241 | 5/1960 | Guimbretiere et al. | 19/282 X |
| 3,090,081 | 5/1963 | Klein | 19/248 X |
| 3,417,633 | 12/1968 | Robinson | 19/244 |
| 3,699,766 | 10/1972 | Archambault | 57/315 X |
| 3,738,093 | 6/1973 | Ingham | 57/315 |
| 4,100,004 | 7/1978 | Moss et al. | 423/447.2 X |

*Primary Examiner*—Louis Rimrodt
*Attorney, Agent, or Firm*—John R. Doherty

[57] ABSTRACT

Device for aligning and attenuating soft or brittle fiber mats employing a rotating vacuum roller for gently grasping the fiber mats under sufficient compressive force to hold the same without breaking or otherwise damaging the fiber mats.

5 Claims, 3 Drawing Figures

12230

DEVICE FOR ALIGNING THE ATTENUATING FIBER MATS

The present invention relates to a novel and improved device for aligning and attenuating fiber mats. More particularly, the invention relates to a novel and improved device for aligning and attenuating soft or brittle fiber mats such as staple carbon fiber mats, without seriously affecting the fiber length distribution.

Devices for aligning and attenuating fiberous assemblies such as glass or steel fiber mats, for example, are known in the prior art. Such devices generally comprise a series of roller nips which are each driven at a faster rate of speed than a preceding roller nip. The fiber mats are aligned and attenuated by drafting the mats between each pair of roller nips where an acceleration of fiber speed occurs due to the different speed at which each roller nip is driven. The problem with devices of this type is that the series of roller nips subject the fiber mats to relatively high compressive forces which are applied directly across the individual fibers. Thus, when these devices are employed to align and attenuate soft or brittle fiber mats such as staple carbon fiber mats, the mechanical forces applied to the fiber mats by the roller nips may be too high and may result in frequent fiber breakage or damage.

It is therefore an object of the present invention to provide a novel and improved device for aligning and attenuating fiber mats.

A more specific object of the present invention is to provide a novel and improved device for aligning and attenuating soft or brittle fiber mats such as staple carbon fiber mats, without seriously affecting the fiber length distribution.

Another object of present invention is to provide a novel and improved device for aligning and attenuating staple carbon fiber mats for use particularly in the fabrication of high strength, composite materials.

The foregoing and other related objects and advantages are attained by the novel and improved device for aligning and attenuating fiber mats in accordance with present invention. This novel and improved device employs a rotating vacuum roller for gently grasping the fiber mats after they have been fed through a preceding roller nip. The vacuum roller has an outer air-permeable tubular member which is adapted to rotate around an inner stationary cylindrical core. The stationary core forms a vacuum chamber on its outer surfaces adjacent to the rotating air-permeable tubular member. A continuously moving air-impermeable, flexible belt is positioned in contiguous relationship to the rotating tubular member and forms therewith a nip for gently grasping the fiber mats as they approach the vacuum roller. The air-impermeable flexible belt also extends into contact with the portion of the rotating tubular member opposite the vacuum chamber whereby upon application of a vacuum to the chamber the flexible belt exerts a compressive force against the fiber mats which is sufficient to hold the mats in fixed position against the rotating tubular member but without breaking or damaging the fibers. Means are also provided for rotating the tubular member at a predetermined speed which will impart to the fiber mats a faster rate of linear speed than that at which the fiber mats travel through the preceding roller nip.

In a preferred embodiment of the present invention, the preceding roller nip is formed by a pair of spaced apart, parallel apron belts which are driven by a pair of soft, spongy rollers.

As used herein and in the appended claims, the term "align" or "alignment" shall refer to the substantially uniform distribution of individual fibers in the fiber mats with their major axes, i.e., fiber lengths, arranged in substantially parallel relationship along the direction of fiber flow. The term "attenuate" or "attenuation" refers to the reduction in fiber flux that occurs due to acceleration of the fiber flow in one direction.

The present invention will now be described in greater detail with reference to the accompanying drawing, in which.

Figure 1:
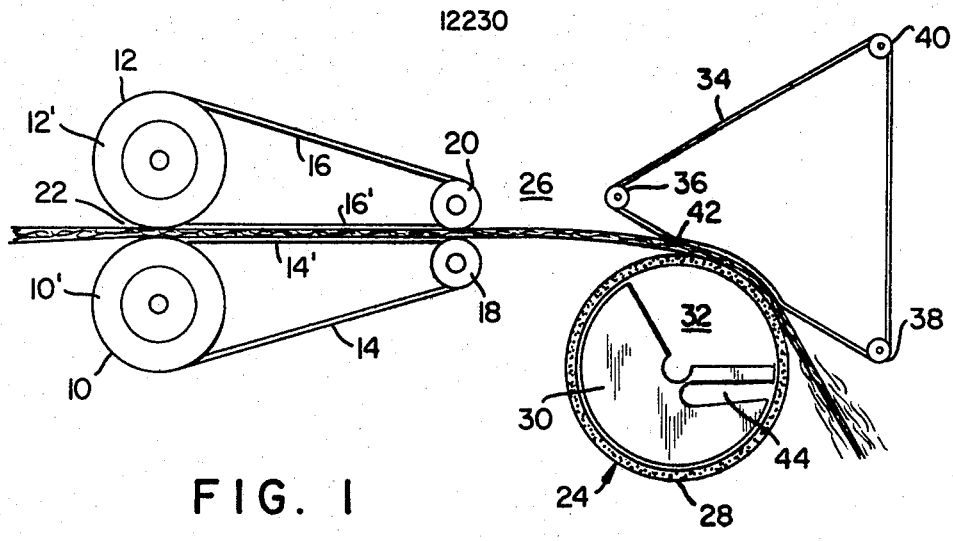
FIG. 1 is a schematic elevational view of a device for aligning and attenuating a soft or brittle fiber mat in accordance with the present invention.
Figure 3:
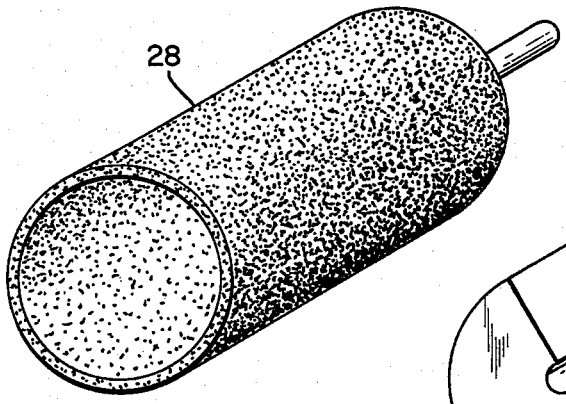
FIG. 3 is a perspective view of the inner stationary core used in the same device.
Figure 2:
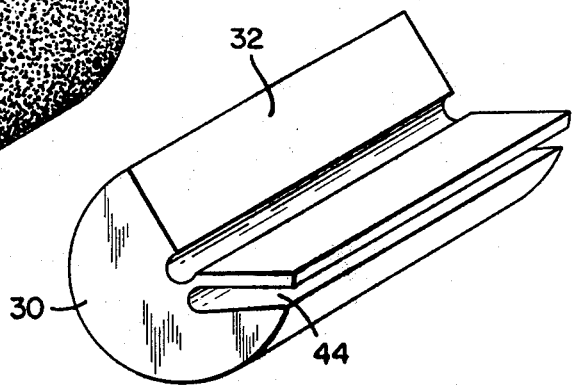
FIG. 2 is a perspective view of the rotating air-permeable tube used in the device shown in FIG. 1.

For the sake of simplicity, the device of the present invention shall be described herein with particular reference to the alignment and attenuation of staple carbon fiber mats. Carbon fiber mats of the type to which the present invention is particularly adapted are those made, for example, by spinning a carbonaceous mesophase pitch. In general, the carbon fiber mats comprise a continuous, elongated relatively thin mass of non-woven carbon fibers which are spun in randomly oriented fashion and intermittently contacting relationship with each other throughout the body of the fiber mat. For particular use in the fabrication of yarn and certain high strength carbon fiber composites, it is desirable to further treat the spun carbon fiber mats by aligning the individual fibers with their major axes oriented in one direction.

Referring now to the drawing in detail, there is shown a preferred embodiment of a device for aligning and attenuating a soft or brittle fiber mat in accordance with the present invention. As shown, the device includes a pair of soft spongy rollers 10, 12 which are placed close together in parallel relationship with their axes of rotation in the same vertical plane and which are rotated in opposite directions by any suitable drive mechanism such as an electric motor driven gear box (not shown). The rollers 10, 12 drive a pair of continuous flexible apron belts 14, 16, respectively, which cover the surface of each roller 10, 12. The apron belts 14, 16 are driven around a pair of idler rollers 18, 20 which are also closely spaced together and arrange so that segments of the apron belts are maintained in close parallel relationship as at 14', 16'. The rollers 10, 12 may each have a solid hub with outer surface layers 10', 12' made of a soft spongy material such as sponge rubber or the like. Typically, the rollers 10, 12 are each about 1 inch in diameter with the outer surface layers 10', 12' about 0.50 inch in thickness. The apron belts 14, 16 may be of made any flexible, relatively soft material such as polyurethane, for example.

The staple carbon fiber mat to be aligned and attenuated is fed between the pair of soft spongy rollers 10, 12 and is grasped immediately by the two apron belts 14, 16 which cover the rollers and form the nip 22. The soft spongy rollers 10, 12 exert a relatively low compressive force on the fiber mat which is sufficient to gently hold the fiber mat as it passes between the rollers but without destroying or damaging the individual fibers. After the fiber mat exits from between the feed rollers 10, 12, the mat is gently carried between the parallel segments of the apron belts 14', 16' to the pair of idler rollers 18, 20. The apron belts continue to exert a small compressive load on the fiber mat.

A rotating vacuum roller 24 is provided for drawing the fiber mat through a space 26 of predetermined length between the exit end of the roller-belt arrangement and the vacuum roller 24. The vacuum roller 24 includes an outer air-permeable tube 28 which is suitably arranged to rotate around an inner stationary cylindrical core 30. The stationary core 30 is made of a low friction material such as Teflon[1], for example, and fits snugly inside the rotating air-permeable tube 28. The tolerance of the fit between the air-permeable tube 28 and the stationary cylindrical core 30 should be very small, e.g., about 2 mils difference between the diameter of the tube 28 and core 30.

[1]DuPont Reg. T.M. for polytetrafluoroethylene family of resins.

Also, the stationary cylindrical core 30 is formed in the upper half thereof with a pie shaped cut-out section 32 located on the outer surfaces adjacent to the rotating air-permeable tube 28. The pie shaped cut-out section 32 serves as a vacuum chamber as shall be described hereinafter. The size of the cut-out section 32 may be about 120° in the radial section, for example.

The tube 28 can be made from any air-permeable material through which a vacuum can be drawn, such as porous metal. In one working example of the present invention, the tube was fabricated from porous Type 316 Stainless Steel seamless tubing manufactured by the Mott Metalurgical Corporation. This tube had a filtration rating of about 20 microns. The dimensions of the tube used in this device were 4.0 inches O.D., 0.125 inch thickness, and 3.75 inches in width. This tube was driven in rotation about an inner cylindrical Teflon core by a variable speed motor. The Teflon core had an outer diameter of 3.73 inches and thus maintained a tolerance of 2 mils between the Teflon core and the outer tube.

Although not shown in the drawing, means are provided in the device for evacuating the chamber 32 inside the core 30. A high capacity vacuum blower has been used successfully for this purpose, e.g., a vacuum blower capable of drawing 92 inches of water and 400 SCFM against atmospheric pressure.

A continuous, air-impermeable, flexible belt 34 is arranged in contiguous relation to the vacuum roller 24 with three idler rollers 36, 38 and 40 assembled so that a portion of the belt extends into contact with the rotating tube 28 at a location opposite the vacuum chamber 32. Idler roller 36 leads the belt 34 onto the tube 28 and is placed a short distance above the tube so as to form a nip 42 for grasping the fiber mat as it approaches the vacuum roller 24. In a similar manner, idler roller 38 is placed above the rotating tube 28 and directs the belt away from the surface of the tube at the exit end of the vacuum roller 24.

The belt 34 may be made from any suitable impermeable plastic film material such as a polyurethane film, for example. Although the thickness of the belt is not critical, the belt should be at least as wide as the aligned fiber mat. The belt 34 is driven solely by the frictional forces between the belt and the rotating tube 28 and, to this end, idler rollers 36, 38 are placed so as to maintain optimal frictional contact with the surfaces of the tube.

Thus in operation of the device of the present invention, the fragile carbon fiber mat is first fed between the pair of soft spongy rollers 10, 12 and apron belts 14, 16 which gently grasp the fiber mat while at the same time moving the fiber mat at a predetermined speed in a direction toward the vacuum roller 24. The soft spongy rollers 10, 12 exert a significant level of compressive force on the fibers in a direction across the fiber axes without causing any fiber damage. This is made possible, of course, by the ability of the soft spongy rollers to deform under load, thus widely distributing the forces over the mat. Moreover, the apron belts 14, 16 apply an auxiliary transverse pressure on the mat after it exits from between the rollers 10, 12 which pressure remains on the mat while it is being conveyed in a direction toward the roller 24. The fibrous mat then passes through the space 26 between the roller-belt assembly and the vacuum roller 24 and enters the nip 42 formed between the belt 34 and the rotating tube 28. The nipping action that occurs at this point forces the mat gently against the surface of the porous tube 28 and with the chamber 32 evacuated, the mat is held in relative fixed position against the tube by the belt 34. The compressive forces exerted by the belt 34 against the fibrous mat can be controlled by the vacuum applied to the chamber 32 and should be maintained at a level where the compressive forces are just sufficient to hold the mat in fixed position against the tube 28, but without crushing the fibrous mat or otherwise damaging the fragile fibers.

Means are provided (but not shown) for rotating the porous tube 28 at a rate of speed which will impart to the fiber mat a faster linear rate of speed than that at which the mat is carried by the apron belts 14, 16. This difference in linear rate of speed causes an acceleration of the individual fibers in the space between the roller-belt assembly and the vacuum roller whereby alignment and attenuation of the fiber mat is achieved. Any suitable mechanism may be employed for this purpose as will readily occur to those skilled in the art.

The stationary core 30 may also be provided with a small slot 44 just below the exit end of the roller through which a jet of air may be blown in order to doff or remove the aligned fiber mat from the tube 28. In practice, a jet of air under pressure of about 30 psi gauge is suitable, for example.

The following experiment serves to illustrate the effectiveness of the device of the present invention.

A pitch base mesophase carbon fiber mat was cut into 1 inch widths and passed through an aligning device of substantially the same construction as described hereinabove. The average fiber diameter of the mat was about 11.7 microns and the average fiber length was 3.56 centimeters. After alignment and attenuation of the fiber mat in the device, the mats were incorporated into resin composites for testing. Composites were made by wetting the mat with a 10% by weight phenoxy resin solution consisting of a 4:1 mixture of methyl ethyl ketone and toluene. After drawing, 20 layers of the mat were placed in an hydraulic press having a platen temperature of 175° C. to form sheets ranging in thickness from 0.01 inch to 0.02 inch. Specimens of approximately ½ inch × 2 inches were cut from the sheets and placed in a tensile tester where Youngs modulus (E) values were obtained.

Identical composite samples were made with the exception that the fibers were not passed through the alignment device. The Youngs modulus (E) values for these samples were also obtained in similar manner. The average E for aligned fiber composites was $4.58 \times 10^6$ psi whereas the average E for unaligned fiber composites was $1.82 \times 10^6$ psi. Since the Youngs modulus of the composites is directly related to the degree of fiber alignment within the composite, other factors being equal, it can be concluded that the device of the present invention improves the fiber alignment by a factor of about 2.5 to 1. It should also be noted that this improvement can be attained with very minimal amount of fiber breakage which is suprising in view of the fact that the fibers are extremely fragile.

What is claimed is:

1. In a device for aligning and attenuating fiber mats wherein the mats are fed through a series of roller nips, each one of which is driven at a faster speed than a preceding one in the series of roller nips, the improvement whereby relatively soft or brittle fiber mats can be aligned and attenuated without seriously affecting the fiber length distribution, said improvement comprising in combination:

at least one preceding roller nip;

a vacuum roller comprising an inner stationary cylindrical member and an outer rotating air-permeable tubular member, said stationary cylindrical member forming a vacuum chamber in an outer surface portion thereof adjacent to said rotating tubular member;

a continuously moving air-impermeable flexible element which is located in contiguous relationship to said rotating tubular member forming therewith a roller nip adapted to receive the fiber mat upon passing from the preceding roller nip and also extending into contact with the portion of said tubular member opposite said vacuum chamber whereby upon application of a vacuum to said chamber said flexible element exerts a compressive force against said fiber mat which is sufficient to hold the mat in relative fixed position against said tubular member but without breaking or damaging the fiber mat; and means for rotating said tubular member at a rate of speed which will impart to the fiber mat a faster linear rate of speed than that at which the mat passes through the preceding roller nip.

2. A device according to claim 1 wherein the preceding roller nip is formed by a pair of continuous, flexible apron belts arranged in spaced apart, parallel relationship which gently grasp and hold the fiber mats, each apron belt being driven at the same linear speed by one of a pair of soft spongy rollers.

3. A device according to claim 1 wherein the inner stationary cylindrical core further includes means for blowing a jet of air through said rotating tubular member for removing the fiber mat therefrom.

4. A device according to claim 1 wherein the flexible element comprises a plastic film belt supported by a series of idler rollers arranged such that the belt contacts said rotating tubular member at a location opposite said vacuum chamber.

5. A device according to claim 1 wherein said rotating tubular member comprises a porous metal seamless tube having a filtration rating of approximately 20 microns.

* * * * *

UNITED STATES PATENT AND TRADEMARK OFFICE

CERTIFICATE OF CORRECTION

PATENT NO. : 4,290,170

DATED : September 22, 1981

INVENTOR(S) : David S. Brookstein and Alton R. Colcord

It is certified that error appears in the above—identified patent and that said Letters Patent is hereby corrected as shown below:

In the title, "THE" should read "AND".

Signed and Sealed this

First Day of December 1981

[SEAL]

*Attest:*

GERALD J. MOSSINGHOFF

*Attesting Officer*

*Commissioner of Patents and Trademarks*